United States Patent [19]

Grant

[11] Patent Number: 4,506,829

[45] Date of Patent: Mar. 26, 1985

[54] VARIABLE SPEED DAMPER MEANS

[76] Inventor: Willie T. Grant, 400 S. Simms St., Lakewood, Colo. 80228

[21] Appl. No.: 507,474

[22] Filed: Jun. 24, 1983

[51] Int. Cl.[3] ..... F24F 13/14

[52] U.S. Cl. ..... 236/49; 49/82; 98/121.2; 137/601

[58] Field of Search ..... 236/49, 9 A; 98/102, 98/107, 110, 121 A, 40 VT; 49/82, 74; 137/601

[56] References Cited

U.S. PATENT DOCUMENTS

| | | | |
|---|---|---|---|
| 1,631,355 | 6/1927 | Baldwin | 248/295.1 X |
| 2,271,487 | 1/1942 | Nessell | 236/9 A |
| 4,056,048 | 11/1977 | Milroy | 98/121 A X |
| 4,184,288 | 1/1980 | Magill et al. | 98/110 X |
| 4,275,762 | 6/1981 | Field | 137/601 |

*Primary Examiner*—William E. Tapolcai

[57] ABSTRACT

Automatic damper means having damper blades rotatably mounted in an adjustable housing, said blades being rotatable between open and closed positions by electrically energized motor means and attaching rotating means; interchangeability of said rotating means connecting to damper blades provide for a variation in the rpm's of said damper blades.

14 Claims, 11 Drawing Figures

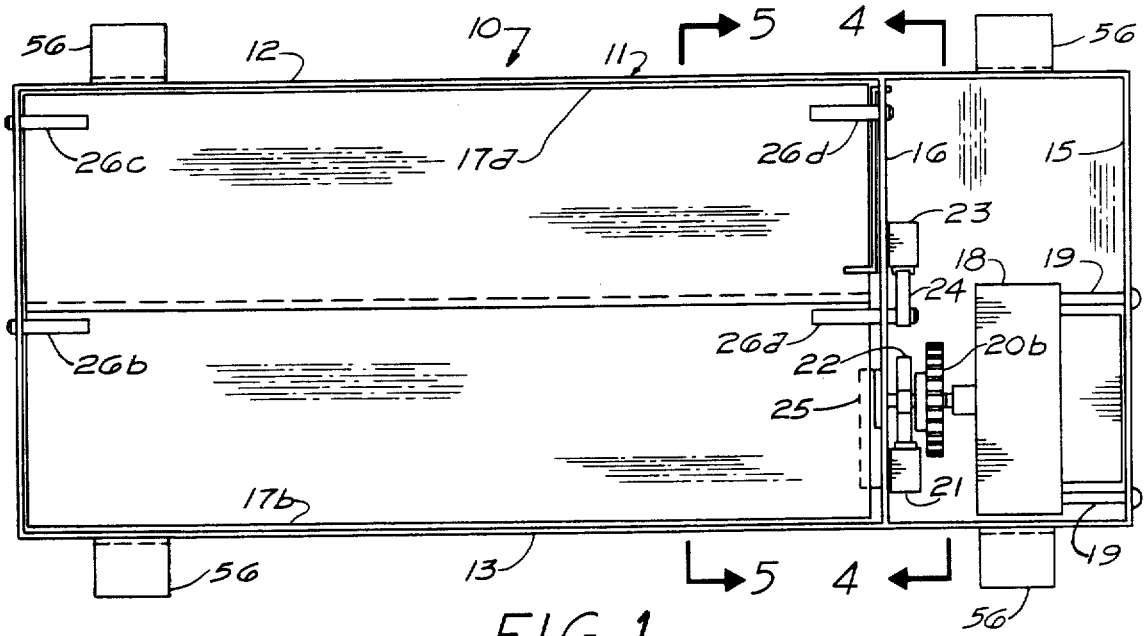
FIG. 1
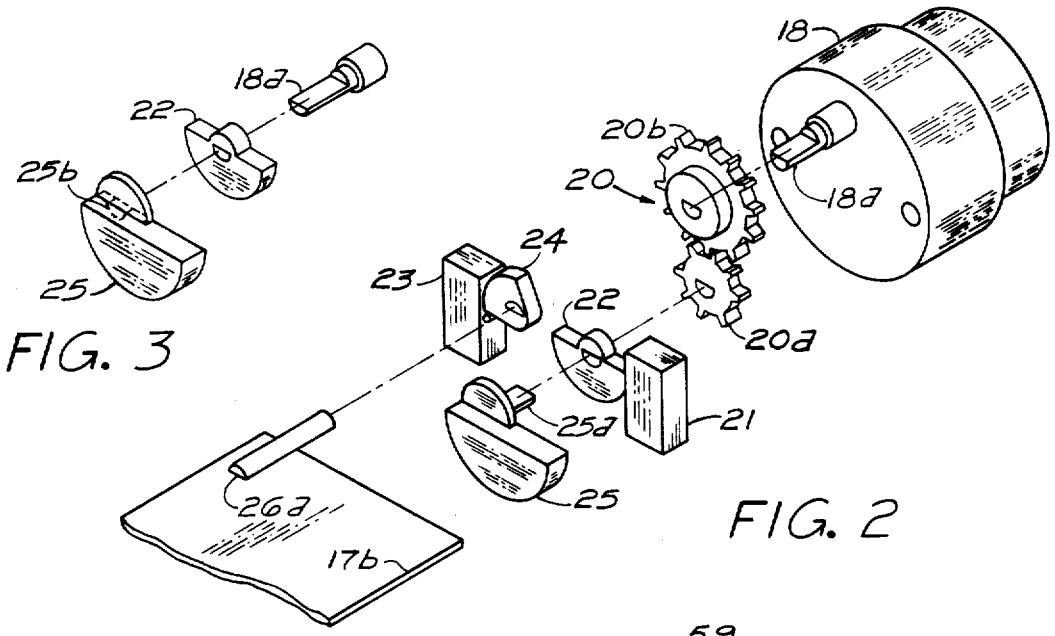
FIG. 3
FIG. 2
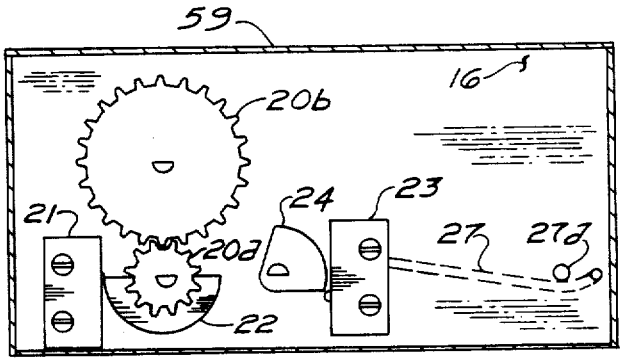
FIG. 4

VARIABLE SPEED DAMPER MEANS

In central heating/cooling installations having rotating damper blades controlling a heating/cooling medium flowing through ducts, the velocity of the medium and the angular velocity (rpm's) of the damper blades sometimes cooperate to produce undesirable sounds as the blades immediately leave or approach a closed position whenever the medium is flowing through said ducts.

The present invention provides damper means whereby the rpm's of the damper blades may be changed to satisfy the user's requirement for sound reduction.

The subject invention incorporates multiple damper blades rotatably mounted in an adjustable housing. Each blade is supported within the housing by means of bearing pins attached to the blades and rotates in holes formed in end panels of said housing. An electrically operated motor having its shaft attaching to a first gear rotates a second gear meshing with said first gear. As the second gear rotates under the influence of the first gear, a cam, having a shaft securing said second gear and a switch operator, influences one of said multiple blades to move with said cam into an open position. Linkage means interconnecting cam following blade to other blades urge all blades to an open or closed position depending on movement of the blade following said cam; said blades being in a fully open position when they are vertical.

As the cam rotates to close the blades, a torsion spring provides a restoring force that returns blades to the closed position, and limit switches, activated by switch operators, energize and deenergize motor means at the open and closed positions of said blades. The rpm's at which the damper blades rotate are established by the ratio between the first and second gear diameters.

The rpm's of the blades can also be varied when a first or primary timing pulley is secured to the shaft of motor means and secondary timing pulleys, having equal diameters with each other but different from said first timing pulley, connect to said damper blades, the rpm's of the damper blades being directly related to the diameter ratio of primary and secondary pulleys.

A third and more direct method of varying blade rpm's is the use of motors having different speeds, and having aforesaid cam attaching directly to the shaft of the motor means. The rpm's of the blades will be equal to the rotational velocity of the motor shaft.

It is the primary purpose of the invention to provide motor operated damper means that permit the rpm's of the damper blades to be varied in accordance with the requirements of the user.

A better understanding of the invention can be had by addressing the accompanying drawings in detail, wherein:

FIG. 1 shows a plan view of the damper means of the present invention;

FIG. 2 is an exploded view showing the spatial relationships among the several components of the damper means;

FIG. 3 is a partial exploded view showing alternate drive means;

FIG. 4 is a cross-sectional view along line 4—4 of FIG. 1;

Figure 5:
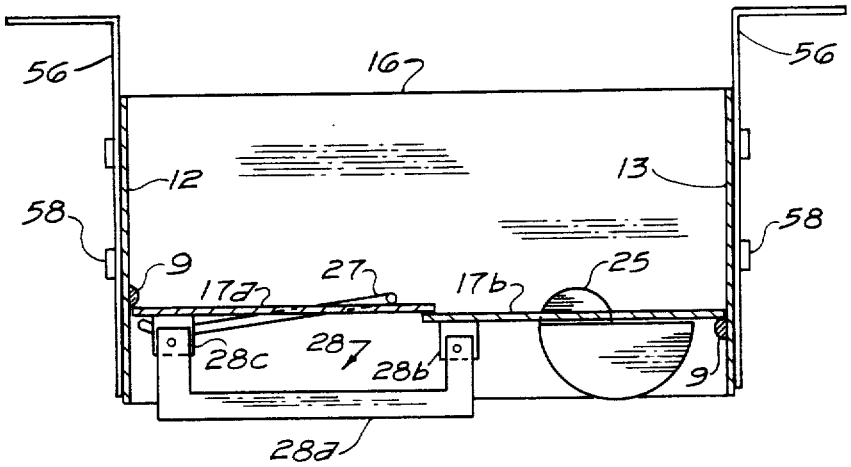
FIG. 5 is a cross-sectional view along line 5—5 of FIG. 1 showing damper blades in a closed position.
Figure 6:
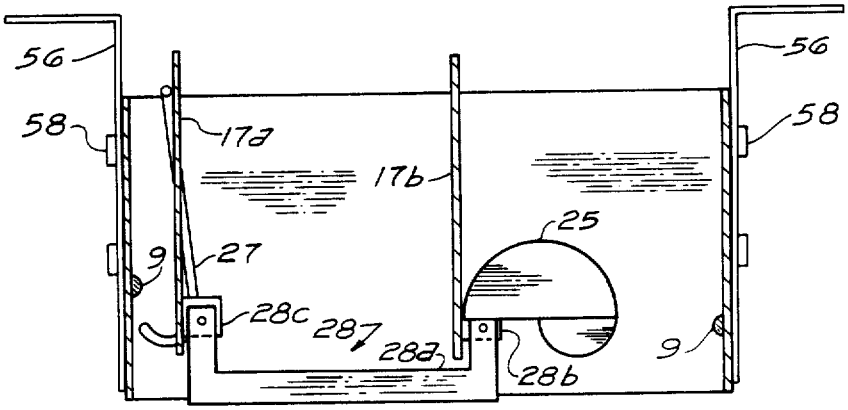
FIG. 6 is a view similar to FIG. 5 showing damper blades in an open position.
Figure 11:
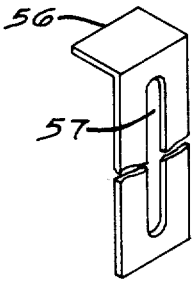
FIG. 11 is an isometric view of adjustable support means.

Making reference to the particular drawing Figures, FIG. 1 shows an automatically operated damper means 10 having damper housing 11 formed of side panels 12 and 13, end panels 14 and 15, and an interior panel 16. As shown in FIG. 11, said damper housing is adjustably supported by bracket 56 having slotted opening 57 capable of moving vertically along an axis containing fasteners 58. The horizontal leg of bracket 56 is constructed to be supported on means external to said damper means, such as floor, wall, or ceiling members when vertical leg of said bracket is secured to panels of damper housing 11 by fasteners 58 (FIGS. 5 and 6).

The top and bottom sections of the damper housing are open, but a series of intermediate damper blades 17 open and close to control and regulate the flow of a heating/cooling medium passing through said damper housing 11. Damper blades **17*a* and 17*b*, representative of the multiplicity of blades that can be mounted in the damper housing, have bearing pins 26 mounted on off-center axes of said damper blades and are rotatably supported in holes in end panel 14 and intermediate panel 16. Motor means 18 is mounted on end panel 15 by fasteners 19. The shaft 18*a* (FIG. 2) captures gear 20*b*, said gear 20*b* meshing with gear 20*a* which attaches to shaft 25*a* of damper operating cam 25. As shown in FIGS. 1, 5, and 6, damper blade 17*b* rests on a ledge of cam 25, and on resilient means 9 bonding to housing panels, when blades are in a closed position. As cam 25 rotates counterclockwise, blade 17*b* is moved to the vertical or open position by the leading edge of said cam. Linkage means 28, being comprised of a connector bar 28*a* and plates 28*b* and 28*c* interconnect blade 17*a* to 17*b* forcing blade 17*a* to rotate with cam follower blade 17*b***.

Figure 7:
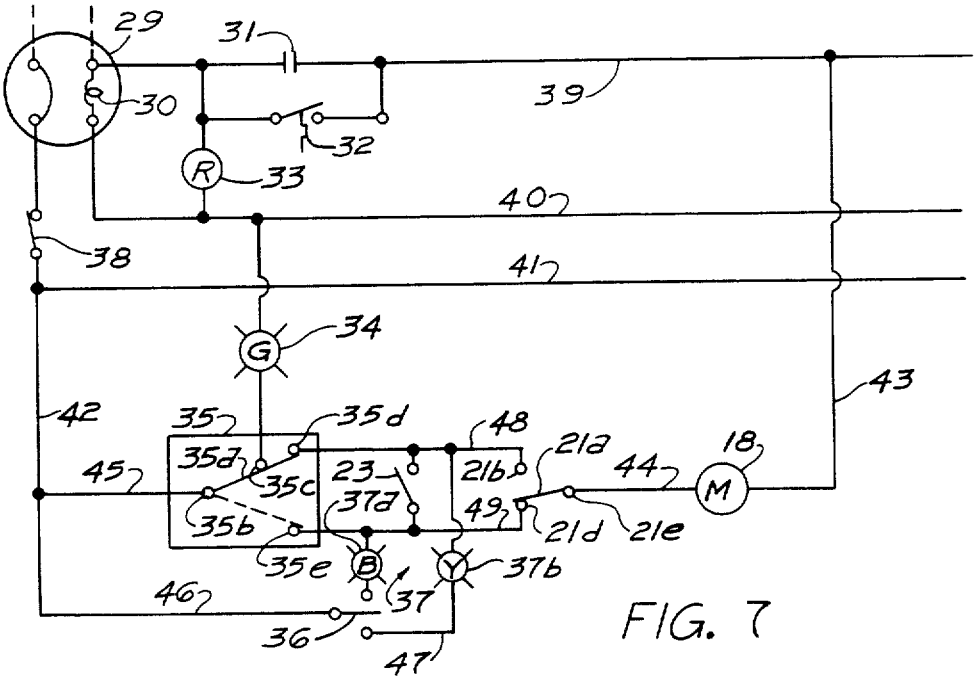
FIG. 7 is the schematic diagram of the present invention.

The preceding rotation of damper blades occurs when thermostatic means 35 of FIG. 7 requests that the temperature of the controlled environment be increased from that of the present status. Accordingly, switch lever **35*a* of thermostatic means 35 moves to position 35*b*–35*d*, energizing light means 34, relay coil 33 and solenoid 30 of fuel control means 29. Simultaneously, motor means 18 is energized through switch lever 21*a* (dashed position) and contacts 31 (said contacts were closed when relay coil 33 was energized). The resulting rotation of motor means 18 culminates in the opening of said damper blades 17 by cam 25. During the described operation simultaneous functions were performed by the switch operating cams 22 and 24 attached to motor shaft 18*a* and bearing pin 26*a*** respectively.

As motor means 18 was energized, switch operating cam 22 (FIG. 2) engaged motor switch 21 maintaining it in a closed position for continuous energization of motor means 18 during the present cycle. In like manner, switch operating cam 24 engaged hold-in switch 23 to maintain an auxillary closed circuit between thermostatic means 35 and motor means 18 should switch lever 35a inadvertently be moved to position 35b–35e while switch lever 21a was being held in position 21c–21d by switch operating cam 22. Hold-in switch 23 continued to provide a closed circuit for motor means 18 until damper blades are rotated to the position consistent with the operational status of the heating/cooling device. Damper blades 17 remain in an open position during the time thermostatic switch lever 35a is energizing fuel control means 29.

Upon reaching the desired temperature, thermostatic switch lever 35a moves to the dashed position, releasing control over relay means 33, fuel control means 35, light means 34, and reenergizes motor means 18; switch lever 21a being in position 21c–21d. As motor shaft 18a rotates damper operating cam 25 counterclockwise, torsion spring 27 (FIG. 6) influences damper blade 17b to follow said damper operating cam 25; said blade 17b riding along the curvature of cam 25 until damper means are in a closed position. During this cycle, switch operating cam 22 does not contact switch 21 thereby leaving switch lever 21a (FIG. 7) in position 21c–21d, compatible with position 35c–35e for thermostatic switch lever 35a. However, the hold-in switch 23 is again maintained in a closed position as switch operating cam 24 rotates in a clockwise direction with damper blade 17b.

In FIG. 7 it can be observed that relay means 33 and fuel control means 29 are subject to control by a multiplicity of thermostats connecting to conductor 40; thermostatic means 35 being representative of other thermostats downstream. Thus, whenever current is flowing in conductor 40, the relay means will be energized and normally open contacts 31 will be closed allowing motor means 18 to rotate when required. However, when thermostatic means 35 are the last means of all thermostats to go off line, relay coil is deenergized and contacts 31 opened when switch lever 35a moves to position 35b–35e; hi-temperature switch 32 mounted in a hot zone of the heating/cooling device remains in an open position thereby preventing motor means 18 from being energized to close damper blades 17. This delay in closing said damper blades allows residual conditioned air in the heating/cooling device to be transported into the room. As said heating/cooling device cools, hi-temperature switch 32 closes, completing the previously open circuit of the motor means, and motor means 18 rotate damper blades 17 to the closed position shown in FIG. 5.

When conditions require that all thermostatic means be disengaged from the fuel control means 29, manual switch 38 provides a central on-off station. A second manually operated switch 36, having light means 37 provides for manual operation of motor means 18 independently of thermostatic means 35; said light means 37 communicating the open/close position of said damper blades 17.

Based on the foregoing description of the operation of the damper means and the spatial relationship of gear means 20 shown in FIG. 2, it can be seen that a change in the diametric ratio of gears 20a and 20b will change the rpm's of said damper blades 17.

Figure 8:
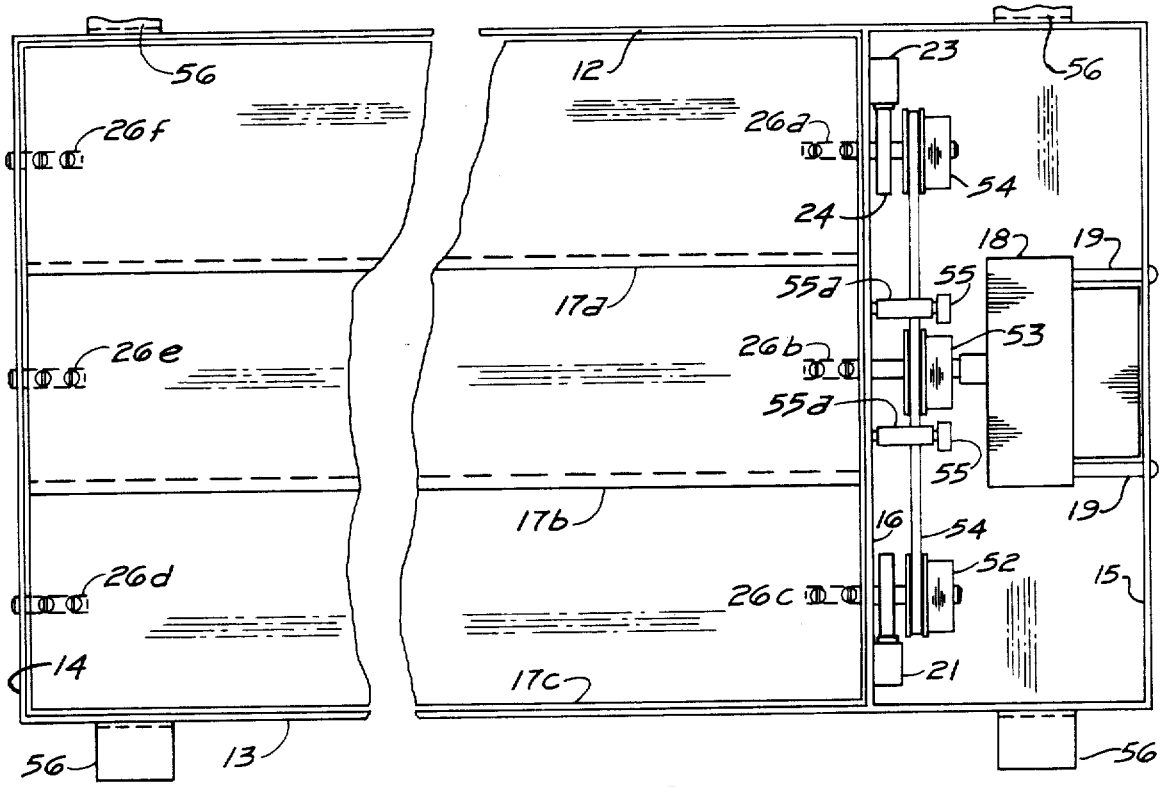
FIG. 8 is a plan view of the damper means having an alternate drive means.
Figure 9:
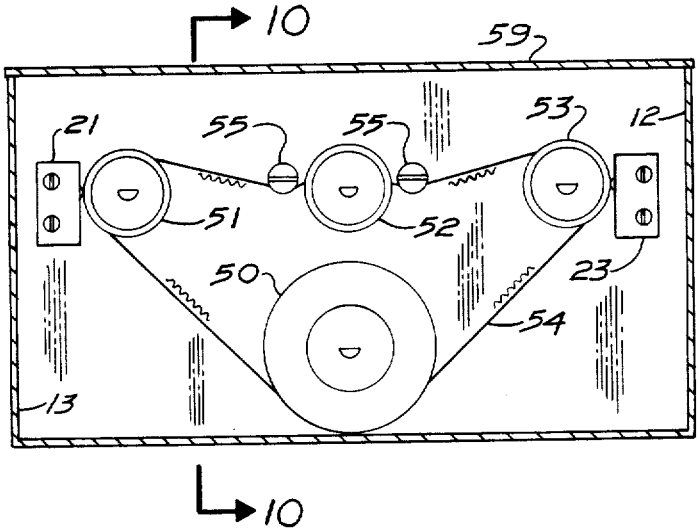
FIG. 9 is an elevational view showing alternate drive means of FIG. 8.
Figure 10:
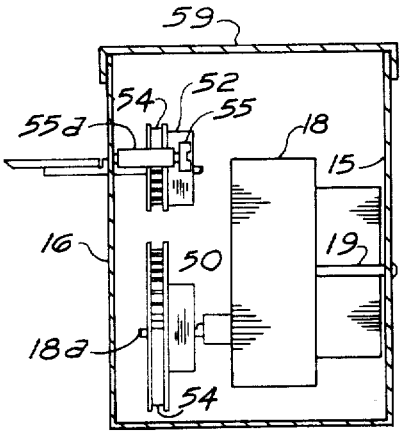
FIG. 10 is a section along line 10—10 of FIG. 9.

An alternate means for varying the rpm's of the damper blades incorporates the transmission means shown in FIGS. 8–10. Where component numbers shown in these Figures are identical to previously used numbers, it indicates that said components are also identical in both cases.

FIG. 8 shows the damper means having a multiplicity of damper blades 17a–17c rotatably supported by bearing pins 26a–f. Each of said bearing pins extending through intermediate panel 16 captures a timing pulley 51 through 53, said pulleys being partially encircled by belt 54. Continuous belt 54 also partially encircles drive pulley 50, said drive pulley attaching to motor means 18.

Bearing pins 26a and 26c have attaching switch operating cams 24 and 22 for operation of motor switch 21 and hold-in switch 23 respectively as heretofore explained.

Referring to FIG. 7, when switch lever 35a of thermostatic means 35 moves to position 35b–35c and motor means 18 are energized to open damper blades 17, motor shaft 18a rotates pulley 50 through an arc sufficient to rotate pulleys 51–53 through an angle of 90 degrees, whereupon switch operating cams 22 and 24 disengage said switches to deenergize motor means. Upon being satisfied thermostatic means 35 moves switch lever 35a to position 35b–35e and motor means, being again energized by switch lever 21a presently in position 21c–21d, rotates pulley 50 until pulleys 51–53 have rotated 90 degrees and closed damper blades 17, whereupon switch operating cam 22 and 24 deenergize motor means as previously stated. Belt 54 serving to transmit rotation from pulley 50 to pulleys 51–53 is maintained in a tensile condition by belt tensioners 55 having rotating sleeves 55a to reduce friction on said belt as said belt 54 passes over said sleeves.

As with the gear means in FIG. 2, the rpm's of the damper blades can be altered by changing the diametric ratio of pulley 50 versus pulleys 51–53.

When independent means are utilized to determine the most favorable rpm's for a given system of blades, motor means 18 can be selected from a rather wide range of timing motors having specified rpm's; and shaft 18a (FIG. 3) can be connected directly to damper operating cam 25 via opening 25b. As cam 25 operates damper blades 17 as previously described, all other functions, including operation of torsion spring 27 (FIGS. 6 and 7), switch operating cams 22 and 24, and switches 21 and 23, are performed in the same manner described for the operation of the motor means having gear means rotating said damper operating cam 25.

As shown typically in FIGS. 4, 9, and 11 all housing means incorporate motor covering means 59 for sealing off motor compartment and protecting motor means.

Thus, there has been shown and described a novel automatic damper means which fulfills all of the objectives and advantages sought after. Many changes, modifications, variations and other uses and applications of the present device will, however, become apparent to those skilled in the art after considering this specification and accompanying drawings. All such changes, modifications, variations, and other uses and applications which do not depart from the spirit and scope of the invention are deemed to be covered by the invention which is limited only by the claims which follow:

I claim:

1. Automatic damper means, having speed changing means controlling and regulating the flow of a heating/cooling medium through a duct network; said duct network attaching to heating/cooling means having fuel control means, said fuel control means and said damper means being simultaneously controlled by thermostatic means; said damper means comprising in combination:

(a) housing means,
said housing means comprising a frame having open top and bottom sections, said frame having adjustable support means mounting thereon;
(b) closure means,
said closure means pivotally mounting in said housing means and rotatable between open and closed positions by transmission means;
(c) said transmission means,
said transmission means comprising motor means, switch operating means, and said speed changing means; said transmission means mounting to said housing means;
(d) indicating means,
said indicating means communicating the operational status of said heating/cooling means and a relative position of said closure means in said housing means;
(e) control means,
said control means comprising said thermostatic means, switch means and motor control means; said thermostatic means providing an electrical interlock between said transmission means, said indicating means, said motor control means, and said fuel control means;
(f) motor control means,
said motor control means comprising a coil and a high temperature switch connecting said motor means to said fuel control means.

2. The closure means defined in claim 1 having a first switch actuator, said actuator operating a hold-in switch of said switch means.

3. The means defined in claim 1 wherein said speed changing means comprise gear means, said gear means having a first gear attaching to said motor means and a second gear attaching to closure operating means.

4. The means defined in claim 3 wherein said closure operating means comprise a cam, said cam rotating said closure means to an open position; restoring means, said restoring means rotating said closure means to a closed position; and linkage means, said linkage means interconnecting a multiplicity of damper blades of said closure means.

5. The means defined in claim 1 wherein said switch means comprise a first manual switch connecting said fuel control means to said thermostatic means; a second manual switch providing a bypass of said thermostatic means and operating said motor means; said hold-in switch and a motor control switch interlocking said motor means and said thermostatic means; said motor control means interconnecting said motor means and said fuel control means.

6. The means defined in claim 1 wherein said speed changing means comprise pulley means and belt means; said pulley means connecting to said closure means and motor means; said belt means circumventing said said pulley means, said belt means having tensioning means, said tensioning means maintaining said belt means in a tightened condition.

7. The means defined in claim 1 wherein said transmission means having said speed changing means and said motor means as a single entity; a variation in the speed of rotation of said closure means being accomplished by an interchange of said motor means; said motor means being attached to said closure operating means, said closure operating means including said cam and said restoring means.

8. Automatic damper means having closure means operable by variable speed means; said closure means, in combination with thermostatic means controlling individual temperature gradients in rooms and zones; said rooms and zones receiving a flow medium from a heating/cooling appliance having fuel control means, said damper means comprising:
(a) housing means,
said housing means comprising a frame having open top and bottom sections, said frame having adjustable support means mounting thereon;
(b) said closure means,
said closure means pivotally mounting in said housing means and rotatable between open and closed positions by transmission means;
(c) said transmission means,
said transmission means comprising motor means, switch operating means, and said variable speed means, said transmission means mounting to said housing means;
(d) indicating means,
said indicating means, being light means, communicating the operational status of said heating/cooling means and a relative position of said closure means in said housing means;
(e) control means,
said control means comprising said thermostatic means, switch means and motor control means; said thermostatic means providing an electrical interlock between said transmission means, said indicating means, said motor control means, and said fuel control means;
(f) motor control means,
said motor control means comprising a coil and a high temperature switch connecting said motor means to said fuel control means.

9. The closure means defined in claim 8 having a first switch actuator, said actuator operating a hold-in switch of said switch means.

10. The means defined in claim 8 wherein said variable speed means comprise gear means, said gear means having a first gear attaching to said motor means and a second gear attaching to closure operating means.

11. The means defined in claim 10 wherein said closure operating means comprise a cam, said cam rotating said closure means to an open position; restoring means, said restoring means rotating said closure means to a closed position; and linkage means, said linkage means interconnecting a multiplicity of damper blades of said closure means.

12. The means defined in claim 8 wherein said switch means comprise a first manual switch connecting said fuel control means to said thermostatic means; a second manual switch providing a bypass around said thermostatic means and operating said motor means; said hold-in switch and a motor control switch interlocking said motor means and said thermostatic means; said motor control means interconnecting said motor means and said fuel control means.

13. The means defined in claim 8 wherein said variable speed means comprise pulley means and belt means; said pulley means connecting to said closure means and motor means; said belt means circumventing said pulley means, said belt means having tensioning means, said tensioning means maintaining said belt means in a tightened condition.

14. The means defined in claim 8 wherein said transmission means having variable speed means and said motor means as a single entity; a variation in the speed of rotation of said closure means being accomplished by an interchange of said motor means; said motor means being attached to said closure operating means; said closure operating means including said cam and said restoring means.

* * * * *